United States Patent [19]

Cartee et al.

[11] Patent Number: 4,821,620

[45] Date of Patent: Apr. 18, 1989

[54] BULLET TRAP WITH ANTI-SPLATTER SAFETY SCREEN

[75] Inventors: Larry A. Cartee; Harry A. Barot, both of Schaumburg, Ill.

[73] Assignee: Detroit Armor Corporation, Schaumburg, Ill.

[21] Appl. No.: 144,320

[22] Filed: Jan. 14, 1988

[51] Int. Cl.[4] ..... F41J 1/00; F41H 5/04

[52] U.S. Cl. ..... 89/36.02; 273/410

[58] Field of Search ..... 89/1.1, 36.02; 273/410

[56] References Cited

U.S. PATENT DOCUMENTS

| | | | |
|---|---|---|---|
| 1,935,174 | 11/1933 | Bisaillon et al. | 273/410 |
| 2,380,393 | 7/1945 | Berg | 89/36.02 |
| 2,815,955 | 12/1957 | Dear | 273/410 |
| 3,924,038 | 12/1975 | McArdle et al. | 89/36.02 |
| 4,151,996 | 5/1979 | Lee et al. | 273/410 |

FOREIGN PATENT DOCUMENTS

| | | | |
|---|---|---|---|
| 2839370 | 3/1980 | Fed. Rep. of Germany | 89/36.02 |
| 815467 | 6/1959 | United Kingdom | 273/410 |
| 2065277 | 6/1981 | United Kingdom | 273/410 |

OTHER PUBLICATIONS

Simonetti, IPN W085/05672, Dec. 19, 1985.

*Primary Examiner*—David H. Brown
*Attorney, Agent, or Firm*—Lee & Smith

[57] ABSTRACT

An anti-splatter screen safety apparatus in which a screen of rubber-like material adapted to self-closing when penetrated by bullets is secured to the front face of a deflector plate for a bullet trap and spaced forwardly of the front face to form a space between the screen and the plate. When penetrated by a bullet which then strikes the plate, the material of the screen immediately closes behind the bullet to block passage of the spent bullet, fragments and particulate. The space between the screen and the plate allows bullets to completely penetrate the screen and allows all spent bullets and all fragments and particulate from spent bullets to move through the space without restriction to a well of the bullet trap. The screen provides total protection against splattering of bullets, fragments and particulate, prevents ricochet of all spent bullets, and contains all spent bullets, fragments and particulate. When used with a bullet trap for air guns, the screen also acts as a shock absorber to slow bullets fired from the gun before they strike the deflector plate, and the sound of initial impact is lessened and subsequent impact with the plate is muffled so that use of a bullet trap with the anti-splatter screen is more quiet than use of a bullet trap without such a screen.

15 Claims, 2 Drawing Sheets

BULLET TRAP WITH ANTI-SPLATTER SAFETY SCREEN

BACKGROUND OF THE INVENTION

This invention relates to an apparatus for deflecting and trapping bullets, fragments and particulate during target shooting with deformable bullets, and particularly to a bullet trap for use with an air gun which shoots lead pellets, which bullet trap provides total protection against splattering of spent pellets, fragments and particulate.

The term "bullet" is used in a broad sense herein to mean any projectile shot from devices such as firearms, air guns, or any device which hurls a projectile.

In target shooting it is customary to use a bullet trap immediately behind the target for deflecting and trapping spent bullets. The anti-splatter bullet trap of this invention is particularly well suited for use as the bullet trap of the system for retrieval and replacement of targets which is described in detail in another patent application filed by the inventors of this application on the same day as this application Ser. No. 144,417, filed Jan. 14, 1988, and assigned to the same assignee, said other application being entitled "Target Retrieval System" and identified by Attorneys File No. 973-1000 (hereinafter "applicants' cofiled application").

The principal problem encountered with prior art bullet traps of which the inventors are away is the splattering of bullet fragments and particulate and occasional ricochet of a spent bullet. As deformable lead bullets strike the metal deflector plate of a bullet trap, small fragments and particulate tend to splatter outwardly and sometimes escape the trap. Also, spent bullets may ricochet sufficiently that they are not caught in the well of the bullet trap, occasionally with sufficient force to create a danger to bystanders. While conventional bullet traps do catch most spent bullets, fragments and particulate, the lead debris which escapes the trap is deposited on the floor or on the ground near the bullet trap assembly.

Deposit of lead fragments and particulate on a floor or on the ground creates a serious danger to small children who later play or crawl near where the bullet trap has been used. Children playing with toys, balls, etc., in the area can pick up lead dust and small lead particles on such toys or on their hands. Children often put toys and their hands up to their mouths and thus are in danger of ingesting lead. This can cause a child to become ill and might even cause death from lead poisoning.

Aside from the danger of lead poisoning, the splattering of lead dust and small particles on a floor or on the ground is unsightly and objectionable and requires cleaning of the area after the use of a bullet trap. Furthermore, inasmuch as lead from bullet traps is often reclaimed by serious marksmen, lead which escapes the trap results in monetary loss.

PRIOR ART BULLET TRAPS

The inventors are not aware of any prior art bullet trap utilizing an anti-splatter screen of the character described hereinafter.

Prior art bullet traps known to the inventors are those of the type used with the target retrieval systems identified as prior art in applicants' cofiled application.

Although the bullet trap assembly of the applicants' cofiled application is not prior art to this application, it does describe the use of a bullet trap with a typical deflector plate. For convenience, the anti-splatter screen of this invention will be described in conjunction with the bullet trap of applicants' cofiled application.

SUMMARY OF THE INVENTION

Except for the addition of the anti-splatter screen which is to be described, the bullet trap assembly with which the present invention may be employed is the same as the bullet trap assembly disclosed in the applicants' cofiled application, to which reference is made for a detailed description.

The anti-splatter bullet trap of the present invention utilizes an anti-splatter or anti-ricochet screen of gum rubber or the like in front of the deflector of the bullet trap. The anti-splatter screen is spaced forwardly of the metal deflector plate by the spacer in the form of a deformable extrusion which is secured to the two side edges and the top edge of the deflector plate. The side and top edge portions of the screen are secured to the spacer thus forming a space between the screen and plate. Bullets which are fired at and pass through a target in front of the bullet trap also pass through the anti-splatter screen and strike the deflector plate behind the screen. All spent bullets, fragments and particulate are confined to the space between the screen and the deflector plate, and after impact they slide downwardly toward the well of the bullet trap. The bottom of the screen is not secured to the deflector. This provides a bottom exit which permits spent bullets, fragments and particulate to drop into the well of the bullet trap.

The anti-splatter safety screen of this invention is made of natural of synthetic rubber which is self-closing or self-healing, that is, when penetrated by a bullet, the material of the screen immediately closes behind the bullet to block passage of the spent bullet, fragments and particulate. The material of the screen will not tear upon penetration but instead closes immediately behind each bullet which penetrates the screen. The screen provides total protection against splattering, preventing ricochet of all spent bullets and containing all fragments and particulate. In addition, when used with a bullet trap for air guns, the screen also acts as a shock absorber to slow pellets fired from the gun before they strike the deflector plate thus permitting the use of a lighter gauge metal for the deflector plate. Furthermore, inasmuch as the pellets first strike the soft screen before striking the metal deflector plate, the sound of initial impact is lessened and subsequent impact with the plate is muffled; thus, a bullet trap employing an anti-splatter screen according to this invention is more quiet in use than a bullet trap not employing such a screen.

The use of a bullet trap with an anti-splatter screen according to the present invention results in an entirely clean and safe environment because the screen contains 100% of spent bullets, fragments and particulate and causes all to be collected in the well of the bullet trap. Not only does this add to safety but it also permits reclaiming 100% of the lead of all bullets which strike the deflector plate.

DETAILED DESCRIPTION OF THE INVENTION

Figure 1:
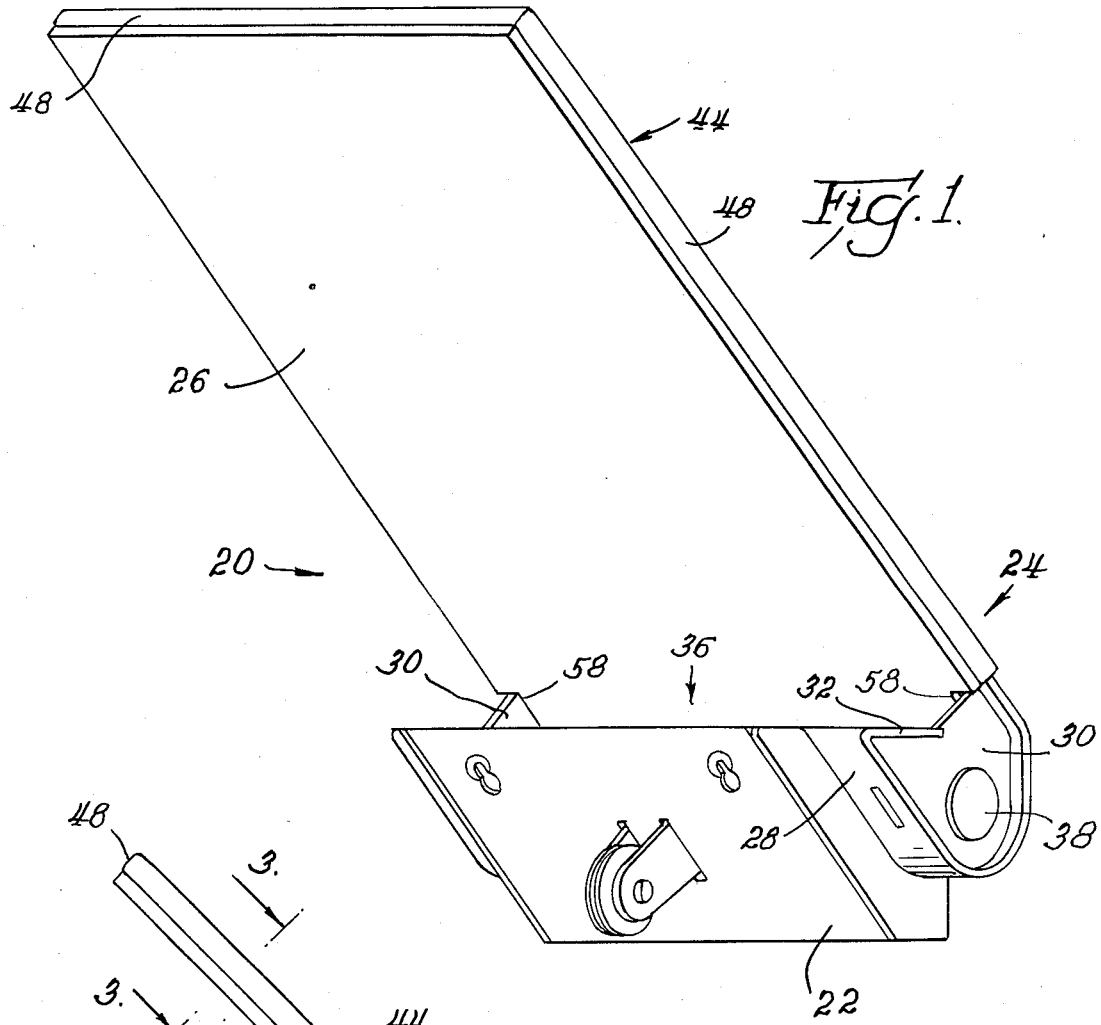
FIG. 1 is a perspective view of a bullet trap assembly like that of the applicant's cofiled application but employing an anti-splatter screen assembly of the present invention.

The bullet trap assembly with anti-splatter screen according to the present invention is generally designated by the reference numeral 20 in FIG. 1. The bullet trap assembly includes a bullet trap mounting bracket 22 and a combined deflector and bullet trap 24, both of which may be identical to those described in the applicants' cofiled application except for the addition of an anti-splatter screen assembly generally designated by the reference numeral 26. Reference is made to applicants' cofiled application, the disclosure of which is incorporated here by reference, for the details of the bullet trap and the associated portions of the target retrieval system with which the bullet trap assembly is used.

Figure 2:
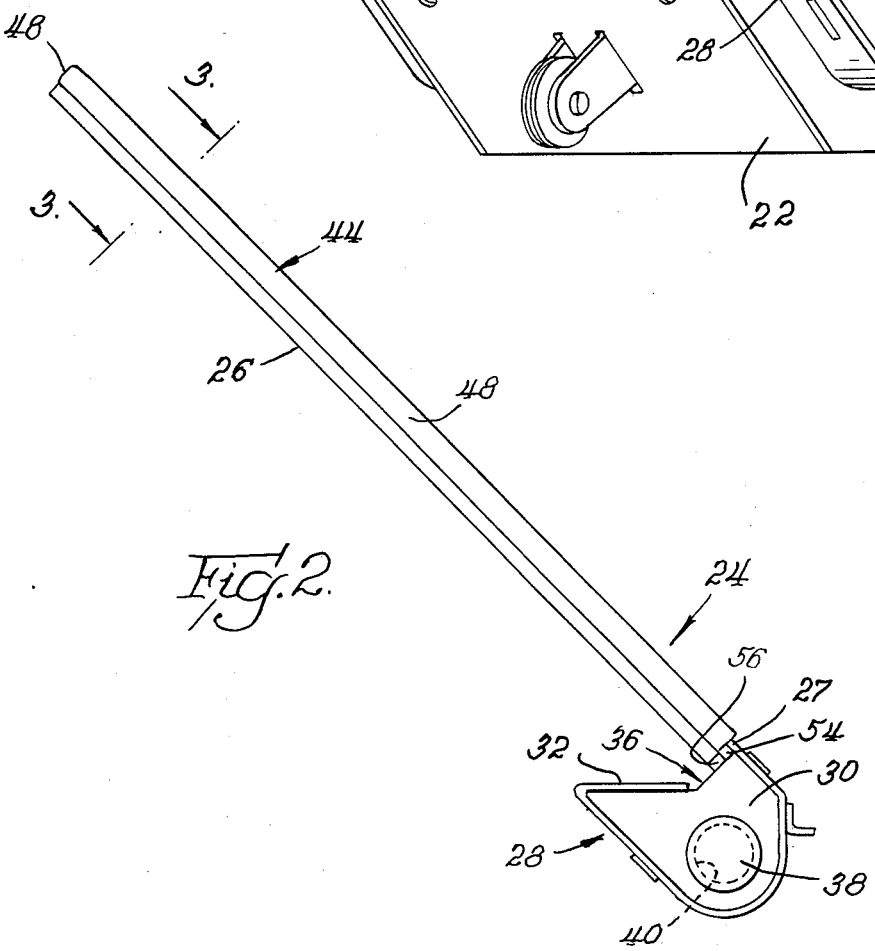
FIG. 2 is a side elevational view of the deflector plate and bullet trap portion of the bullet trap assembly of FIG. 1 removed from the mounting bracket.

The combined deflector and bullet trap 24 is formed of sheet metal and includes a deflector plate component 27 and an integral bullet trap component 28 (FIG. 2). The bullet trap component 28 is generally trough-shaped as shown, including an end closure plate 30 fixedly secured at each end and an integral retainer flange 32 bent at an acute angle along the distal edge of the bullet trap component. This provides a bullet trap well 34 which is closed except for an entry slot 36 which is formed between the edge of the flange 32 and the surface of the deflector plate 27. In order to permit cleaning and ready disposal of spent bullets, fragments and particulate from the bullet trap well 34, removable plugs 38 are snapped into place in respective clean-out apertures 40 formed in the end closure plates 30.

Figures 3, 4:
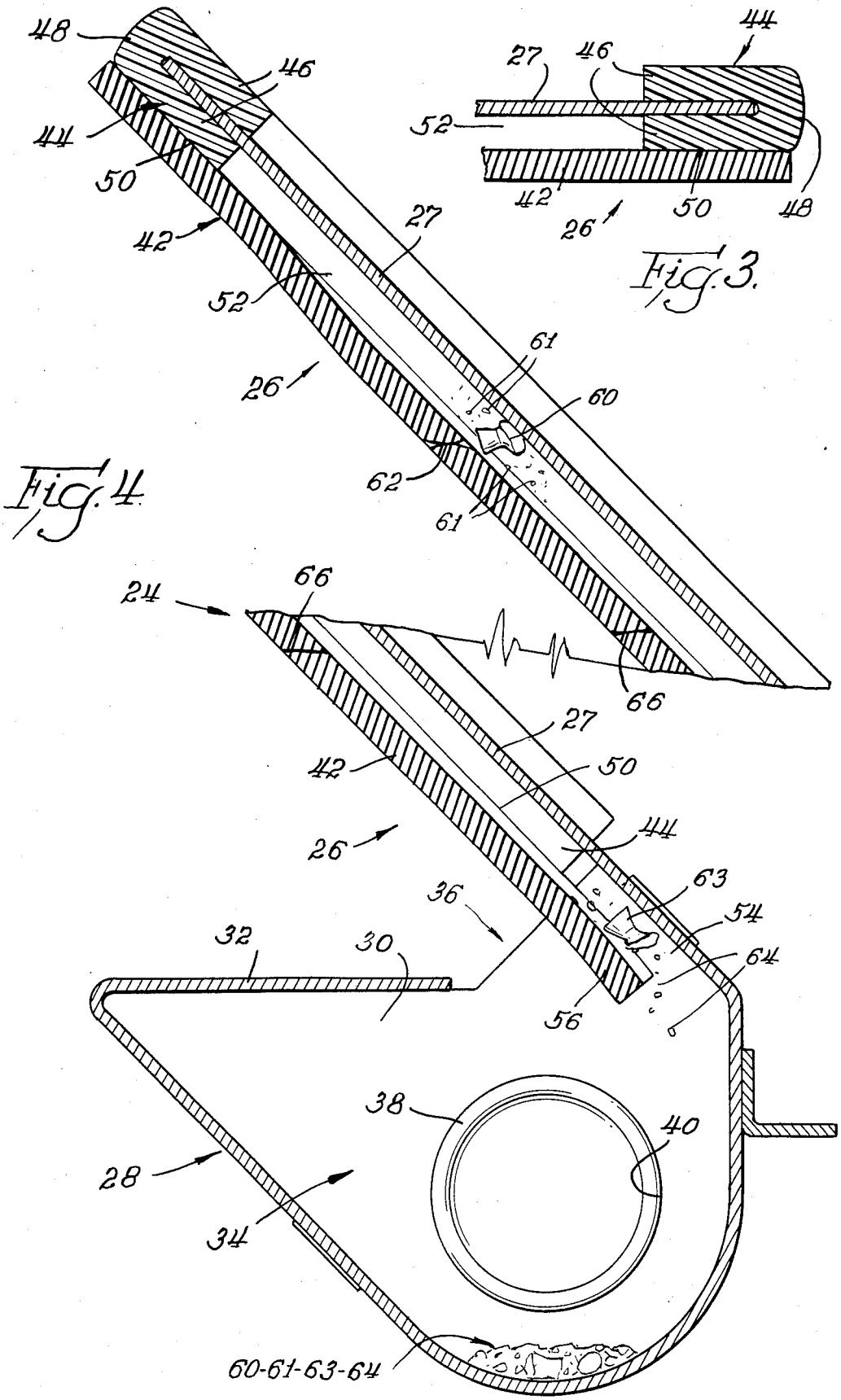
FIG. 3 is an enlarged fragmentary sectional view taken along line 3—3 of FIG. 2 to show the detail of one edge of the anti-splatter screen and the spacer and their association with the deflector plate.
FIG. 4 is an enlarged fragmentary side sectional view of the deflector plate and anti-splatter screen assembly, illustrating the instant a bullet has penetrated the screen and struck the deflector plate, and also illustrating the passage of a spent bullet and fragments toward the bullet trap well.

The anti-splatter or anti-ricochet screen assembly 26 includes two principal components, an anti-splatter screen 42 and a spacer 44. The screen 42 is formed of relatively soft material which will not tear or otherwise deteriorate when penetrated by bullets. The screen is generally planar in use but sags slightly as shown in FIGS. 2 and 4. In the particular embodiment here described the screen is approximately ⅛" in thickness, but other thicknesses may be utilized. The material of the screen is self-closing or self-healing, that is, the hole made by a penetrating bullet is immediately closed behind the bullet as it passes through the material. This immediate closing of all holes insues that no lead fragments or particulate, or even a ricocheting bullet, can pass back through a hole made by a bullet which has penetrated the screen. A natural or synthetic gum rubber has been found to provide the required characteristics of the screen 42.

In the embodiment of the invention here described the spacer 44 is in the form an elastomeric extrusion which is secured along the top and the two side edges of the deflector plate 27. As best seen in FIG. 3, the spacer 44 is U-shaped in cross section, including two legs 46 and an integral bight 48. The spacer is assembled along the three edges of the deflector plate with the legs 46 on opposite sides of the plate and the bight 48 up against or slightly spaced from plate edges (as shown in FIG. 3). The space between the legs 46 before assembly with the deflector plate 27 is slightly smaller than the thickness of the plate; thus, when the spacer is assembled on the plate, it is held in place by friction and gravity.

The side and top edge portions of the anti-splatter screen 42 are fixedly secured to the firing-line-facing leg 46 of the spacer 44 by a suitable adhesive 50. The adhesive 50 is disposed between the surface of the leg 46 and the three adjacent edge portions of the screen. The adhesive secures the screen edge portions to the leg 46 completely around the three sides; alternatively, the spacer could be vulcanized to the screen in order to secure the edges of the screen to the firing-line-facing leg 46 of the spacer. Securing the three edges of the screen 42 to the spacer results in formation of a chamber or space 52 between the opposed surfaces of the screen and the metal deflector plate 27. It has been found that the narrow spacing between the screen and the deflector plate may nominally be ⅛ to 3/16 of an inch for use with an air gun, but the actual spacing is greater because of slight sagging of the screen as shown in FIGS. 2 and 4. The spacing should be sufficient to allow a bullet of the size being fired to completely penetrate the screen 42, taking into account some flattening of the bullet as it strikes the metal deflector plate. Such spacing must also provide sufficient room to allow spent bullets and all fragments and particulate to move downwardly through the space without restriction. The space may be substantially larger if desired.

As best seen by reference to FIGS. 2 and 4, an exit slot or opening 54 is formed between the bottom edge portion of the screen 42 and the opposed surface of the deflector plate 27. The exit slot 54 permits all spent bullets, fragments and particulate to drop into the bullet trap well 34. The exit slot is formed between an unattached bottom edge portion 56 of the screen, which extends downwardly into the bullet trap slot 36 below the upper edges of the closure plates 30. Protrusion of the edge portion 56 into the slot 36 is accommodated by a notch 58 formed at each bottom side edge of the screen to provide clearance past the closure plates.

It should be understood that the anti-splatter screen may be secured to the bullet trap in any suitable fashion, not necessarily to the deflector plate, as long as the screen is held in place in front of the deflector plate and the space between the screen and the plate is confined in order to contain all bullets, fragments and particulate.

FIG. 4 illustrates use of the anti-splatter screen of the present invention with an air gun which fires deformable lead pellets. The figure is a fragmentary sectional view of the bottom portion of the anti-splatter screen assembly 26, showing a portion of the screen 42 and a portion of the deflector plate 27 in cross-section and the legs 46 of the spacer 44 in elevation in the background. At the upper portion of the figure a spent air gun pellet 60 is shown at the instant it has struck the deflector plate 27 after having penetrated through a hole 62 which it made in the screen, which hole closed immediately after passage of the pellet. Small fragments and particulate 61 are formed as the pellet 60 strikes the deflector plate. It is noted that both the spent pellet 60 and the fragments and particulate 61 are contained within the space 52 formed between the anti-splatter screen 42 and the deflector plate 27; at the side and top edge portions of the screen the pellet, fragments and particulate are contained within the space 52 by the confined leg 46 of the spacer 44. In the lower portion of FIG. 4 another spent pellet 63 and accompanying fragments and particulate 64 are shown dropping through the exit 54 into the bullet trap well 34, the pellet 63 having struck the deflector plate 27 after having penetrated the screen 42 through a hole 66, which closed behind the pellet as it passes through the screen. It will be seen that the spent pellet 63 and the fragments and particulate 64 were and are completely contained by the screen 42 and the spacer 44 and thus have passed downwardly through the space 52 toward the bullet trap well.

From the foregoing description it will be understood that 100% of all spent bullets, fragments and particulate ar contained by the anti-splatter screen assembly 20 and pass into the bullet trap well 34. The anti-splatter screen also prevents ricochet and insures that all lead is collected for later disposal or reclaiming.

It should be understood that the anti-splatter screen assembly 26 may be replaced when the screen 42 begins to deteriorate after long usage. This may be readily accomplished by sliding the assembly 26 upward to free the spacer 44 from the deflector plate and then sliding a replacement assembly into place.

In the particular embodiment of the invention shown and described herein the anti-splatter screen assembly 20 has been shown as being formed from two pieces, the screen 42 and the spacer 44. It should be understood that the invention is not limited to such a construction. Instead, the screen 42 and the one leg 46 of the spacer 44 may be integrally formed, thus providing a one-piece screen with thickened side and top edge portions. With such an embodiment the thickened side and top edges are cemented or otherwise secured to the edges of the deflector plate 27, and provide the necessary spacing of the screen from the deflector plate in order to provide a sheet-like confined space 52 between the screen and the opposed surface of the deflector plate.

The anti-splatter screen assembly 20 is not limited to use with the particular deflector and bullet trap described herein but instead may be used with other similar types of bullet traps utilizing deflector plates.

Variations and modifications may be effected without departing from the scope of the novel concepts of the present invention.

We claim:

1. An anti-splatter safety screen apparatus for installation on a bullet trap for trapping deformable bullets which strike one face of a deflector plate and fragments and particulate caused by the impact of bullets with the plate, comprising;

(a) a screen of a rubber-like material adapted for self-closing when penetrated by bullets, (b) means for securing said screen in spaced relation to said one face of the deflector plate to provide a confined space between the screen and the face sufficient to allow bullets to completely penetrate the screen, whereby all spent bullets which strike said face, and all fragments and particulate from spent bullets, are contained within the space and move through the space without restriction, (c) a bullet trap well associated with said deflector plate and arranged to catch and retain all spent bullets, fragments and particulate from said space, and (d) means for removing spent bullets, fragments and particulate from said bullet trap well.

2. The anti-splatter screen apparatus of claim 1 in which said screen and said means for securing said screen are fixedly secured to one another and are replaceable as a unit on said bullet trap.

3. The anti-splatter safety screen of claim 1 in which said bullet trap well is formed integrally with the bottom portion of said deflector plate.

4. An anti-splatter safety screen apparatus according to claim 1 in which said means for removing comprises:

(a) an aperture formed in said bullet trap well, and (b) a clean-out plug removably secured in said aperture, whereby said plug may be removed from said aperture to permit removal of spent bullets, fragments and particulate from the bullet trap well.

5. The anti-splatter screen apparatus of claim 1 in which an exit opening is formed between the bottom portion of said screen and said one face of the deflector plate for directing all spent bullets, fragments and particulate into the well of the bullet trap.

6. An anti-splatter safety screen apparatus according to claim 5 in which said bullet trap well is secured to the apparatus below said exit opening and is arranged for receiving all spent bullets, fragments and particulate.

7. The anti-splatter safety screen apparatus of claim 1 in which said means for securing said screen comprises a spacer secured between the top and the two side edge portions of the screen and the adjacent portion of the deflector plate.

8. The anti-splatter safety screen apparatus of claim 7 in which said scrren is secured to said spacer by vulcanizing.

9. The anti-splatter safety screen apparatus of claim 7 in which said scrren is secured to said spacer by an adhesive between the spacer and the screen.

10. The anti-splatter safety screen apparatus of claim 7 in which said spacer is formed integrally with the top and the two side edge portions of the screen.

11. The anti-splatter safety screen apparatus of claim 1 in which said means for securing said screen comprises:

(a) A spacer of elastomeric material and having a U-shaped cross-section frictionally mounted over the top and the two-side edge portions of the deflector plate, and (b) means for bonding said screen to said spacer.

12. The anti-splatter safety screen apparatus of claim 11 in which said means for bonding comprises vulcanizing between said spacer to said screen.

13. The anti-splatter safety screen apparatus of claim 11 in which said means for bonding comprises an adhesive between said spacer and said screen.

14. The anti-splatter safety screen apparatus of claim 11 in which said means for bonding comprises forming said spacer integrally with said screen.

15. The anti-splatter safety screen apparatus of claim 11 in which said screen and said spacer are replaceable as a unit on said bullet trap.

* * * * *